United States Patent [19]

Raymond

[11] 4,291,969

[45] Sep. 29, 1981

[54] PHOTOGRAPHIC DEVELOPER-PRINTER ASSEMBLY, AND A CONVEYING ROLLER UNIT THEREFOR

[76] Inventor: Gary E. Raymond, 755 Rainbow Dr., Hollywood, Fla. 33021

[21] Appl. No.: 82,652

[22] Filed: Oct. 9, 1979

[51] Int. Cl.[3] ..... G03D 3/08

[52] U.S. Cl. ..... 354/322; 134/64 P; 226/171

[58] Field of Search ..... 354/316, 319, 320, 321, 354/322, 338, 339, 324; 134/64 P, 122 P; 226/170, 171, 196

[56] References Cited

U.S. PATENT DOCUMENTS

| | | | |
|---|---|---|---|
| 2,927,503 | 3/1960 | Zollinger | 354/321 |
| 3,062,123 | 11/1962 | Limberger | 354/324 |
| 3,336,853 | 8/1967 | Friedel | 354/321 |
| 3,359,945 | 12/1967 | Hastings et al. | 354/339 |
| 3,375,770 | 4/1968 | Hellyer | 354/321 |
| 3,413,904 | 12/1968 | Friedel | 354/316 |
| 3,468,693 | 9/1969 | Hanson | 354/320 |
| 3,922,701 | 11/1975 | Geyken et al. | 354/319 |
| 4,034,389 | 7/1977 | Huss | 354/316 |
| 4,099,194 | 7/1978 | Kummerl | 354/338 |
| 4,143,959 | 3/1979 | Fischer | 354/322 |
| 4,181,421 | 1/1980 | Kitrosser | 134/64 P |

FOREIGN PATENT DOCUMENTS

| | | | |
|---|---|---|---|
| 807454 | 6/1951 | Fed. Rep. of Germany | 354/339 |
| 339495 | 8/1959 | Sweden | 354/339 |

*Primary Examiner*—L. T. Hix
*Assistant Examiner*—Alan Mathews
*Attorney, Agent, or Firm*—Thomas N. Neiman

[57] ABSTRACT

The developer-printer assembly comprises a housing having a plurality of tanks formed therewithin for confining developing fluid, fixing fluid, wash water and rinse water, and a plurality of conveying roller assemblies and guides for directing and conveying photographic papers, i.e., photosensitive papers or negatives, which are to be developed and printed, between the tanks, through the fluids and waters. The conveying roller unit, a plurality of which are employed in the developer-printer assembly, has a pair of rollers spaced apart with an intermediate roller interposed therebetween, and bands replaceably looped about the pair of rollers and atop the intermediate roller, for constraining the photographic papers firmly to the intermediate roller. The unit further has a trough for positively directing papers to the intermediate and pair of rollers.

13 Claims, 8 Drawing Figures

PHOTOGRAPHIC DEVELOPER-PRINTER ASSEMBLY, AND A CONVEYING ROLLER UNIT THEREFOR

This invention pertains to photographic processing apparatus, and in particular to developer-printer assemblies, and to conveying roller units therefor, which receive and convey photographic papers therethrough for developing, fixing, washing and rinsing.

Assemblies and units of the type just noted are well known in the prior art, and typically comprise a plurality of rollers and guides which feed the subject papers into and between developing and fixing fluid tanks and washing and rinsing water tanks. Unfortunately, however, the known assemblies and units are constantly subject to paper jamming, as the rollers fail to secure the through-feeding papers and/or such guide elements as are incorporated are not adequate.

It is an object of this invention to set forth improved assemblies and units which avoid such paper jamming and which positively capture and feed papers therethrough.

It is specifically an object of this invention to set forth a photographic developer-printer assembly comprising first means defining a reservoir; partitions subdividing said reservoir into a plurality of tanks; conveying roller assemblies replaceably disposed in said reservoir; second means coupled to said first means, and engaged with said roller assemblies, for rotatably driving said roller assemblies; and guide means disposed adjacent to said roller assemblies, for directing photographic papers, which are to be developed and printed, to said roller assemblies successively; wherein said roller assemblies comprise a pair of spaced apart rollers, an intermediate roller interposed between said pair of rollers, and band means replaceably looped about said pair of rollers and atop said intermediate roller; and said band means comprises a multitude of substantially parallel strands, closely spaced apart, lying normal to said rollers' axes of rotation, for constraining photographic papers which are directed to, and conveyed between said roller assemblies, firmly to said intermediate rollers; and further including means engaged with said intermediate rollers for cleansing the latter of any substances borne on the surface thereof.

It is a further object of this invention to set forth a conveying roller unit, for use in a photographic developer-printer assembly, comprising a pair of spaced apart supports; a pair of spaced apart conveying rollers; said rollers being journalled, at opposite ends thereof, supportingly in said supports; an intermediate roller interposed between said pair of conveying rollers, said intermediate roller also being journalled in said supports; band means replaceably looped about said pair of conveying rollers and atop said intermediate roller; said band means comprising a multitude of substantially parallel strands, closely spaced apart, lying normal to said rollers' axes of rotation, for constraining photographic papers firmly to said intermediate roller; trough means, fixed to said supports, for directing photographic papers therealong to said intermediate and conveying rollers; and auxilliary rollers, rotatably journalled in said supports intermediate said trough means for moving photographic papers along said trough means.

Further objects of this invention, as well as the novel features thereof, will become more apparent by reference to the following description taken in conjunction with the accompanying figures, in which:

FIG. 1 is a discontinuous, side elevational line drawing of the photographic developer-printer assembly, in an embodiment thereof;

FIG. 2, greatly enlarged over the scale of FIG. 1, is a plan view of the assembly of FIG. 1 with the cover top removed for clarity;

Figure 5:
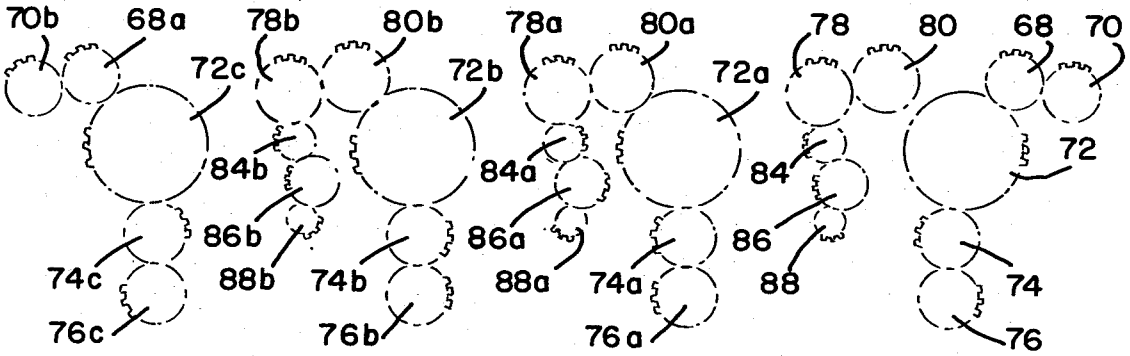
FIG. 5 is a line drawing of the driven gear train for the assembly.

As shown in the figures, a photographic developer-printer assembly 10, according to an embodiment of the invention, comprises a housing 12 which defines a reservoir 14. Walls 16, 18, and 20, which traverse the reservoir, form tanks 22, 24, 26 and 28. The tanks, respectively, are provided for confining therewithin developing fluid, fixing fluid, wash water and rinse water. Housing 12 is enclosed within a cover 30 through which project self-metering fluid and water bottles 32. Within each tank is fixed an overflow pipe 34; the pipes 34 conduct excess fluid or water to discharge means (not shown).

Four conveying roller units 36, 38, 40 and 41 are replaceably set into housing 12, within the tanks 22, 24, 26, and 28 respectively. Each of the units comprises a pair of conveying rollers 42 and 42*a*, which are spaced apart, and an intermediate roller 44 therebetween. A multitude of O-ring-type bands 46 are replaceably fitted into grooves provided therefore in rollers 42, the bands 46 being looped about both rollers 42 and 42*a*, and contrained to travel atop the intermediate roller 44.

Figure 3:
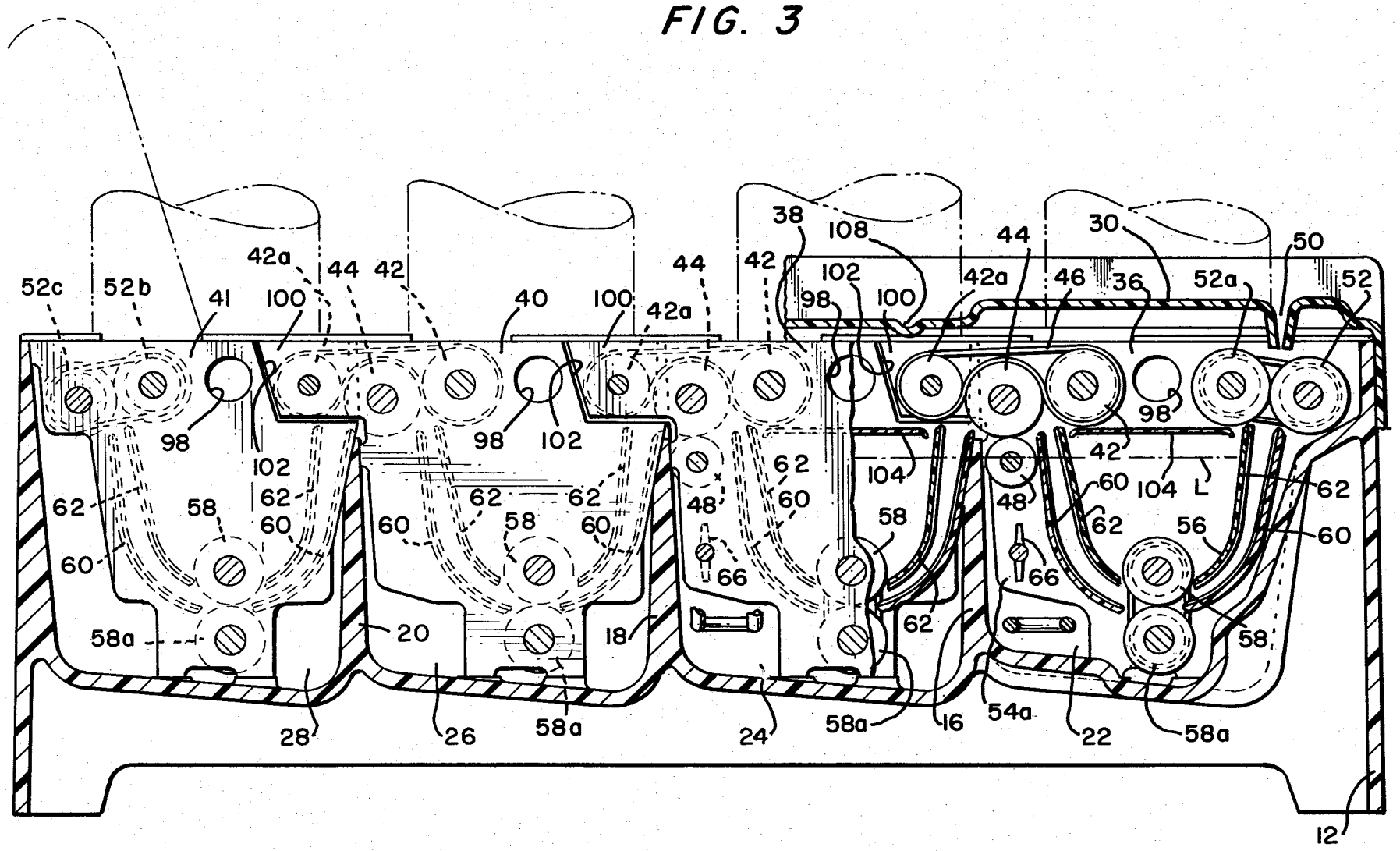
FIG. 3 is a cross-sectional view, taken along section 3—3 of FIG. 2, the view being greatly enlarged over the scale of FIG. 2.
Figures 6, 6A, 7:
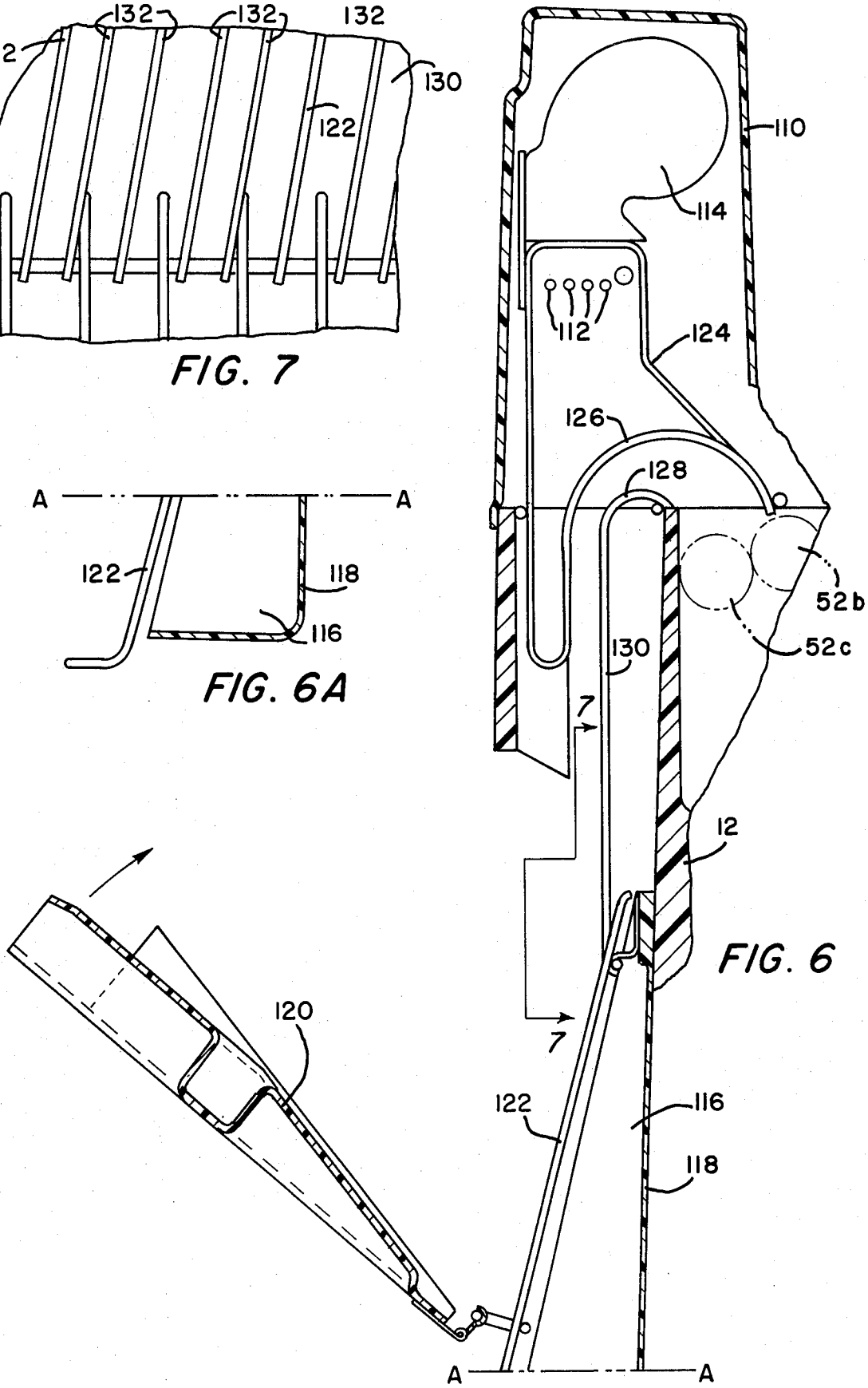
FIG. 6 is an elevational view, in cross-section, showing the exit end of the assembly, with FIG. 6A being a continuation thereof.
FIG. 7 is a view taken along 7—7 of FIG. 6, showing the wire-rod paper guides, the view depicting only a portion of the guides.

During use of the assembly 10, the fluids level is predetermined to be at approximately the line "L" shown in FIG. 3. Now, units 36 and 40, these being the ones associated with the fixing and developing fluids tanks 22 and 24, respectively, have cleansing rollers 48. Rollers 48 are so positioned as to be largely submerged in the fluids and, arranged to rotate in clockwise fashion, carry therewith a quantity of fluid to wash the intermediate rollers 44 which which they are rotatably engaged of stains, chemical deposits, etc. As a consequence, the rollers 44 are cleansed, the fluid carried thereto by rollers 48 obliterate any "wiped" tracks which the O-ring-type bands 46 may have left thereon, and present a clean, uniformly wetted surface to papers conveyed to bands 46 and roller 44.

Cover 30 has an aperture or slit 50 through which the photographic papers are addressed to tank 22, and unit 36 has immediately therebelow a pair of entry rollers 52 and 52*a*. Rollers 52 and 52*a*, like rollers 42, 42*a* and 44, are rotatably journalled at ends thereof in end plates 54 and 54*a*. Immediately below entry rollers 52 and 52*a* is a trough 56 which is interrupted intermediate its length by auxillary rollers 58 and 58*a*. Rollers 58 and 58*a* assist the conveyance of papers through the trough 56.

Figure 4:
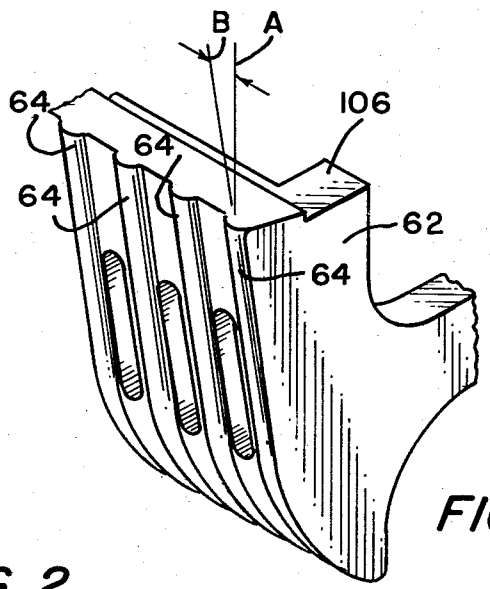
FIG. 4 is a fragmentary, isometric projection of a portion of the paper guide, considerably enlarged to show detail.
Figure 1:
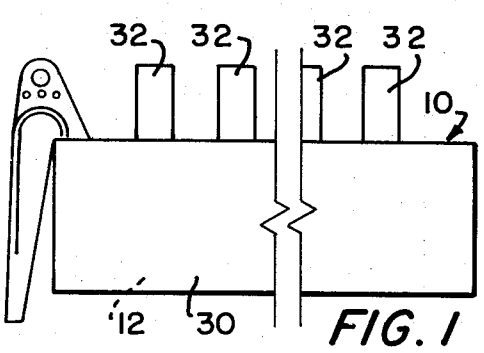
Figure 2:
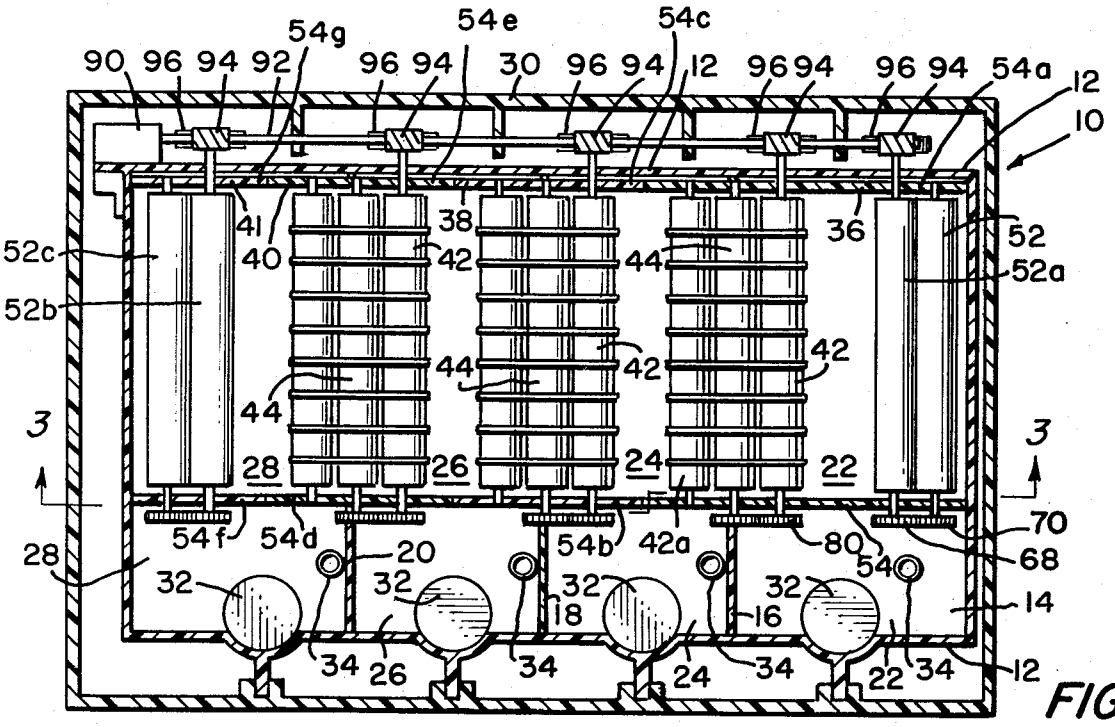

It happens to be phenomena that, when paper is wetted and travels along a linear surface, its travel is inhibited by a surface tension attraction of the linear surface. Now, I have found that this contributes to paper jamming, in developer-printer assemblies. Therefore, to reduce this surface tension attraction, I have defined the troughs 56 with surface tension breaking means. The troughs 56 are formed of substantially parallel elements 60 and 62 and, on the confronting surfaces thereof, I have formed prominent ribs 64. However, the ribs 64 are disposed transverse to the travel direction of the paper which is conveyed through the trough 56. FIG. 4 shows a fragmentary portion of element 62; now line "A" defines a truly vertical attitude from the bottom of tank 22, whereas line "B" denotes the lie of the ribs 64. As the paper travels along the trough 56, and upon the same contacting the ribs 64, its lines of contact are continuously breaking the surface tension by, in effect, sliding away from the ribs 64.

Roller units 36 and 38 have the cleansing rollers 48, and also have fluid agitators 66; units 40 and 41 do not. The gear train, by means of which the rollers and agitators are driven, is shown in FIG. 5; all the gears represented thereat are carried by the plates 54, **54*b*, 54*d* and 54*f*. Roller 52*a* is driven and carries a gear 68 which meshes with gears 70 and 72; gear 70 is fixed to roller 52, and gear 72 is an idler. The latter meshes with a gear 74 which in turn is engaged with a gear 76; gears 74 and 76 are fixed to rollers 58 and 58*a*. Roller 44 is also driven; it carries a gear 78 which meshes with gear 80, which is fixed to roller 42, and meshes with a gear 84 carried by cleansing roller 48. In turn, gear 84 meshes with and drives an idler gear 86 which, sequentially, meshes with and drives a gear 88 carried on a shaft on which is mounted the agitator 66. Rollers 42*a* carry no gears; they are driven by contacting engagement with their mating rollers 442. Except that idlers 72*a*, 72*b* and 72*c* are in mesh with gears 80*a* and 80*b*, rather than gears like gear 68 of entry roller 52*a*, the drive train is substantially similar. Same or similar index numbers in FIG. 5** denote same or similar components.

To the outer side of housing 12 is fixed a drive motor 90. Motor 90 powers a drive shaft 92 on which are fixed worm gears 94. The latter mesh with worm wheel gears 96 which, in turn, impart rotary drive to rollers **52*a*, 42 and 52*b*. Each of the roller units 36, 38, 40 and 41 is separately replaceable from the housing 12. Finger-access holes 98 are provided for replaceable manipulation of the units; it is only necessary to lift the end of the units which is most adjacent to the bottles 32 and slide them slightly in that direction, to disengage the worm wheels 96 from the worm gears 94. Then, the units can be lifted directly upward, and out of the housing 12, for servicing. The units are serially interlocked, however. Units 36, 38 and 40 have laterally extending limbs 100 which fit into recesses 102 provided therefor in the mating units. Hence, it is necessary first to remove unit 36, then unit 38**, etc.

It is undesirable for the developing fluid's vapor, and the fixing fluid's vapor to emerge from the respective tanks 22 and 24. For this reason, vapor barriers 104 are disposed across the well of the troughs 56 to contain the vapors. The barriers 104 rest on the bearing surfaces 106 presented therefor by elements 62 (FIG. 4). More importantly, it is unacceptable for condensate of the fixing fluid to collect under the cover 30 and migrate to where it can deposit in the developing tank 22. Accordingly, a condensate barrier 108, the same comprising an inwardly directed rib which extends across the cover 30, is provided. Hereat the condensate finds a lowermost point from which to drop.

In unit 36, rollers 52, **52*a* 58 and 58*a* are all of the same diameter, however, rollers 42 and 44** thereof are slightly smaller in diameter. Hence, the latter rollers exhibit a slightly, substantially imperceptible, greater rotary speed. In this way, the through-feeding papers are held taut and prevented from jamming or bunching-up.

Supported on the housing 12, adjacent to, and above the exit rollers **52*b* and 52*c*, is a heater-blower housing 110. Housing 110 confines a heater element 112 and thereabove a blower 114. The latter two cooperate to direct drying, heated air into a plenum chamber 116 which is also supported by housing 12 at the end thereof. A triangular-shaped unit defines the chamber, the unit being denoted by the index number 118, and being open on the outermost portion thereof. A pivotably mounted cover 120 is carried by the plenum-chamber defining unit 118 for selectively closing the opening thereof, and for providing access thereinto. A wire-rod rack 122 is fixed in the plenum chamber, for slidably receiving thereon the papers which exit via the rollers 52*b* and 52*c*. A wire rod support 124 fixes the heater element 112 and blower 114 in the housing 110 and has a curved portion 126 which cooperates with a like curved portion 128 of the rack 122 to define a substantially U-shaped way; the latter conducts the processed papers from the rollers 52*c* and 52*b* past the heated air emitting from housing 110 and into the plenum chamber 116**.

As the papers emerging from the rollers **52*b* and 52*c* will frequently have some residual wetness, the upper portion 130 of the rack 122 is defined with oblique rods 132. Again, this is to inhibit the build-up of surface tension on the papers, vis-a-vis the underlying rods 132, as they travel thereupon toward the bottom of the plenum chamber 116**.

While I have described my invention in connection with a specific embodiment thereof, it is to be clearly understood that this is done only by way of example and not as a limitation to the scope of my invention as set forth in the objects thereof and in the appended claims.

I claim:

1. A photographic developer-printer assembly, comprising:

first means defining a reservoir;

partitions subdividing said reservoir into a plurality of tanks;

conveying roller assemblies replaceably disposed in said reservoir;

second means coupled to said first means, and engaged with said roller assemblies, for rotatably driving said roller assemblies; and guide means disposed adjacent to said roller assemblies, for directing photographic papers, which are to be developed and printed, to said roller assemblies successively; wherein said roller assemblies comprise a pair of spaced apart rollers, an intermediate roller interposed between said pair of rollers, and band means replaceably looped about said pair of rollers and atop said intermediate roller; and said band means comprises a multitude of substantially parallel strands, closely spaced apart, lying normal to said rollers' axes of rotation, for constraining photographic papers which are directed to, and conveyed between said roller assemblies, firmly to said intermediate rollers; and further including means engaged with said intermediate rollers for cleansing the latter of any substances borne on the surface thereof; wherein said partitions subdivide said reservoir into a first developing-fluid tank, a second fixing-fluid tank, and a final water tank; further including a pair of exit rollers, rotatably supported in said final tank and coupled to said second means to be driven thereby, for nipping photographic papers and removing the latter from said final tank; and chamber means supported on said first means, adjacent to said exit rollers, in which to collect papers exiting from said final tank; and wherein said chamber means comprises rack means on which slidably to receive papers exiting said final tank and moving into said chamber means for collection therein; and said rack means comprises means for inhibiting surface tension attraction of papers slidably received thereon.

2. A photographic developer-printer assembly, according to claim 1, wherein:

said chamber means comprises a housing;

said rack means comprises a multitude of substantially parallel rods disposed in said housing; and said rods lie on an angle transverse to a path of travel to which photographic papers are constrained upon exiting from said final tank.

3. A photographic developer-printer assembly, according to claim 2, further including:

means supported on said first means, adjacent to said exit rollers, for drying photographic papers exiting from said final tank; wherein said drying means comprises a housing and a heater therewithin, said housing having an open end confronting said exit rollers and said chamber means.

4. A photographic developer-printer assembly, according to claim 3, wherein:

said drying means further comprises a blower.

5. A photographic developer-printer assembly, according to claim 1, further including:

means supported in said first and second tanks defining a vapor barrier.

6. A photographic developer-printer assembly, according to claim 1, further including:

condensate barrier means, supported above said first and second tanks, to prevent condensate from one of said first and second tanks from depositing in the other thereof.

7. A photographic developer-printer assembly, according to claim 1, wherein:

each of said tanks has a roller subassembly replaceably mounted therein;

each of said roller subassemblies has said pair of spaced apart rollers, said band means, one of said intermediate rollers, and further includes a pair of auxilliary rollers, intermediate said guide means, for moving photographic papers along said guide means.

8. A photographic developer-printer assembly, according to claim 1, further including:

a pair of entry rollers, rotatably supported in said first tank and coupled to said second means to be driven thereby, for nipping photographic papers and directing the latter into said first tank; and wherein one of said roller assemblies and second means comprises means for causing said roller assembly to rotate at a peripheral rate of speed which is slightly greater than the peripheral rate of speed at which said entry rollers are caused to rotate.

9. A photographic developer-printer assembly, according to claim 8, wherein:

said second means comprises means for rotatably driving said pair of entry rollers and said roller assemblies at a given rate of speed; and said entry rollers have a diameter which is slightly more than the diameter of said one roller assembly rollers.

10. A photographic developer-printer assembly, according to claim 1, wherein:

said guide means comprises means defining an arcuate trough, one end of said trough being disposed in close proximity to one of said roller assemblies;

said trough comprises elements slightly spaced apart to define a substantially U-shaped channel therewithin;

said trough has an interruption intermediate the length thereof; and further including auxilliary rollers, rotatably mounted within said interruption, for moving photographic papers through said trough.

11. A photographic developer-printer assembly, according to claim 1, wherein:

said guide means comprises means defining an arcuate trough;

said trough comprises elements slightly spaced apart to define a substantially U-shaped channel therewithin;

said elements having confronting surfaces which define inner walls of said channel; and at least one of said surfaces has means for inhibiting surface tension attraction of photographic papers moved through said trough.

12. A photographic developer-printer assembly, according to claim 11, wherein:

all confronting surfaces of said elements have said surface tension attraction inhibiting means; and said surface tension attraction inhibiting means comprises ribs formed on, and extending from, said surfaces which lie transverse to a path of travel to which photographic papers are constrained in movement through said trough.

13. A photographic developer-printer assembly, according to claim 1, further including:

a pair of exit rollers, rotatably supported in said final tank and coupled to said second means to be driven thereby, for nipping photographic papers and removing the latter from said final tank; and means supported on said first means, adjacent to said exit rollers, for drying photographic papers exiting from said final tank.

* * * * *